US007845466B2

(12) United States Patent
Kostun et al.

(10) Patent No.: US 7,845,466 B2
(45) Date of Patent: Dec. 7, 2010

(54) SOUND GENERATOR WITH STRUCTURALLY AND ACOUSTICALLY COUPLED SOUND RADIATION PANEL AND METHOD FOR MANUFACTURING THE SAME

(75) Inventors: John David Kostun, Brighton, MI (US); Mark Donald Hellie, Westland, MI (US); Christopher Edward Shaw, Canton, MI (US); Anthony Charles Arruda, Ann Arbor, MI (US); Martin James Styles, Essex (GB)

(73) Assignee: Visteon Global Technologies, Inc., Van Buren Township, MI (US)

( * ) Notice: Subject to any disclaimer, the term of this patent is extended or adjusted under 35 U.S.C. 154(b) by 28 days.

(21) Appl. No.: 11/846,062

(22) Filed: Aug. 28, 2007

(65) Prior Publication Data

US 2009/0057054 A1 Mar. 5, 2009

(51) Int. Cl.

| | |
|---|---|
| ***F01N 1/08*** | (2006.01) |
| ***F02M 35/12*** | (2006.01) |
| ***F02M 35/16*** | (2006.01) |
| *F01N 1/00* | (2006.01) |
| *F02M 35/10* | (2006.01) |

(52) U.S. Cl. ..... 181/271; 181/273; 181/276; 181/250; 181/156; 123/184.57

(58) Field of Classification Search ..... 181/271, 181/273, 276, 277, 278, 266, 250, 156, 204; 123/184.57, 184.53

See application file for complete search history.

(56) References Cited

U.S. PATENT DOCUMENTS

| | | | | |
|---|---|---|---|---|
| 4,577,495 | A * | 3/1986 | Bamer | 73/114.34 |
| 4,618,025 | A * | 10/1986 | Sherman | 181/148 |
| 4,953,655 | A * | 9/1990 | Furukawa | 181/160 |
| 5,002,021 | A * | 3/1991 | Nakata et al. | 123/184.42 |
| 5,096,010 | A * | 3/1992 | Ojala et al. | 180/68.3 |
| 6,551,389 | B2 * | 4/2003 | Spannbauer et al. | 96/380 |
| 6,600,408 | B1 | 7/2003 | Walter et al. | |
| 6,644,436 | B2 | 11/2003 | Hofmann et al. | |
| 6,848,410 | B2 | 2/2005 | Hoffmann et al. | |
| 6,932,189 | B2 * | 8/2005 | Helber et al. | 181/240 |
| 7,188,703 | B2 * | 3/2007 | Hofmann et al. | 181/271 |
| 7,350,496 | B2 * | 4/2008 | Nakayama et al. | 123/184.57 |
| 7,353,791 | B2 * | 4/2008 | Sasaki et al. | 123/184.57 |
| 2002/0157897 | A1 | 10/2002 | Hofmann et al. | |
| 2005/0121254 | A1 | 6/2005 | Hofmann et al. | |

(Continued)

FOREIGN PATENT DOCUMENTS

| | | | |
|---|---|---|---|
| DE | 19704376 | A1 * | 8/1998 |

(Continued)

*Primary Examiner*—Edgardo San Martin
(74) *Attorney, Agent, or Firm*—Fraser Clemens Martin & Miller LLC; J. Douglas Miller

(57) ABSTRACT

A sound generator for a vehicle is provided, including a hollow drum having a sound radiation panel structurally and acoustically coupled thereto. The drum has an aperture formed in an outer wall thereof. The drum is adapted to be in fluid communication with an air conduit of the vehicle. The sound radiation panel covers at least a portion of the aperture and is adapted to radiate sound energy to at least one of an engine compartment and an interior of the vehicle. A vehicle system including the sound generator and a method for manufacturing the sound generator are also provided.

20 Claims, 5 Drawing Sheets

U.S. PATENT DOCUMENTS

| | | | | |
|---|---|---|---|---|
| 2005/0121255 | A1 | 6/2005 | Hoffmann et al. | |
| 2005/0121256 | A1 | 6/2005 | Hofmann et al. | |
| 2005/0133300 | A1* | 6/2005 | Hofmann et al. | 181/250 |
| 2006/0042873 | A1* | 3/2006 | Alex et al. | 181/250 |
| 2006/0060419 | A1* | 3/2006 | Alex et al. | 181/250 |
| 2006/0283658 | A1* | 12/2006 | Abe et al. | 181/204 |
| 2007/0044747 | A1* | 3/2007 | Sawatari et al. | 123/184.53 |
| 2007/0131189 | A1* | 6/2007 | Shinada et al. | 123/184.57 |
| 2007/0277768 | A1* | 12/2007 | Takeuchi et al. | 123/184.57 |

FOREIGN PATENT DOCUMENTS

| | | | | |
|---|---|---|---|---|
| DE | 101 24 860 | A1 | | 11/2002 |
| DE | 101 47 059 | A1 | | 4/2003 |
| EP | 1 431 536 | B1 | | 12/2003 |
| FR | 2 862 031 | A1 | | 5/2005 |
| JP | 57051910 | A | * | 3/1982 |
| JP | 58091328 | A | * | 5/1983 |
| JP | 58124057 | A | * | 7/1983 |
| JP | 2003262166 | A | * | 9/2003 |
| WO | WO 03/100764 | A1 | | 12/2003 |
| WO | WO 03/100765 | A1 | | 12/2003 |

* cited by examiner

SOUND GENERATOR WITH STRUCTURALLY AND ACOUSTICALLY COUPLED SOUND RADIATION PANEL AND METHOD FOR MANUFACTURING THE SAME

FIELD OF THE INVENTION

The present invention relates generally to a sound generator for a vehicle and, more particularly, to a sound generator for modulation of sound in the engine compartment of the vehicle and the vehicle interior.

BACKGROUND OF THE INVENTION

An internal combustion engine in a vehicle typically is in fluid communication with an air induction system and an air exhaust system for providing air to the engine, and exhausting air from the engine, respectively. In the internal combustion engine, sound energy is often generated in the form of acoustic pressure waves as air flows through the air induction and exhaust systems. In particular, vibrations are often caused by intake air flowing through an air feed conduit of the air induction system. Specifically, vibrations are caused by the induction of air into a cylinder of the internal combustion engine by a cyclic movement of a piston slidably disposed in the cylinder.

Oftentimes in vehicles, such as luxury vehicles, for example, sound energy generation by the air induction is desirably minimized. Resonators have been employed to reduce engine intake noise and improve noise comfort in the vehicle interior. Resonators operate by reflecting sound waves generated by the engine 180 degrees out of phase. The combination of the sound waves generated by the engine with the out of phase sound waves results in a reduction or cancellation of the amplitude of the sound waves. Such resonators typically include a single, fixed volume chamber for dissipating the intake noise. Multiple resonators are also frequently used to attenuate several sound waves of different frequencies.

Many vehicles also use interior sound quality to differentiate from competition. For example, in high performance vehicles and sports cars, the transmission of sound energy to the vehicle interior may provide for a more aesthetically intensive driving experience. The air induction system of a turbo-charged engine, however, is known to generate less sound energy than the induction system of a normally-aspirated engine. Additionally, the air induction system in many vehicles is disposed in a location that does not permit a desired amount of sound to reach the vehicle interior. Thus, devices have been employed to transmit sound energy generated by high pressure areas in the induction system to the engine compartment or the vehicle interior. The sound quality in the vehicle interior may thereby be modulated to provide an aesthetically desirable sound quality.

A known device for generating sound in vehicles has included, for example, a hollow body separated into at least two chambers by a sound transmitting device. The device has sometimes included an output conduit section for transmission of sound to the vehicle interior. Sound generation devices of the art also have employed a spring mass system, such as an oscillating bellows, that typically has a single resonant frequency.

A device for the targeted transmission of sound from an induction tract of an internal combustion engine into the interior of the motor vehicle is disclosed in U.S. Pat. No. 6,600,408. The device includes a hollow transmission body that communicates with the induction tract on the intake side and emits sound on the output side of the vehicle interior. U.S. Pat. No. 6,644,436 discloses a device for noise configuration in a motor vehicle that has a hollow body which is divided into at least two spaces. Further, U.S. Pat. No. 6,848,410 discloses a device for targeted sound transmission from an intake tract that has several resonator chambers operating in parallel.

There is a continuing need for a sound generator that may be used to selectively modulate sound quality in the engine compartment or the vehicle interior. Desirably, the sound generator is readily configurable to meet various tuning requirements. It is also desirable that a structural complexity of the sound generator is minimized.

SUMMARY OF THE INVENTION

In accordance with the instant disclosure, a sound generator that is able to modulate sound quality in the engine compartment of the vehicle interior, is readily configurable to meet tuning requirements, wherein a structural complexity thereof is minimized, has surprisingly been discovered.

In one embodiment, a sound generator for a vehicle comprises a hollow drum having an outer wall with an aperture formed therein, the drum adapted to be coupled to and in fluid communication with an air conduit; and a sound radiation panel at least partially covering the aperture and adapted to radiate sound energy to at least one of an engine compartment and an interior of the vehicle.

In another embodiment, a vehicle system for modulating sound in at least one of an engine compartment and a vehicle interior comprises an internal combustion engine disposed in the engine compartment; an air conduit in fluid communication with the internal combustion engine; a sound generator comprising a hollow drum in fluid communication with the air conduit, the drum having an outer wall with an aperture formed therein; and a sound radiation panel at least partially covering the aperture adapted to radiate sound energy to at least one of the engine compartment and the vehicle interior.

In a further embodiment, a method for manufacturing the sound generator for the vehicle includes the steps of determining a desired sound energy; determining a desired frequency range; selecting a hollow drum with an outer wall having an aperture formed therein; selecting a sound radiation panel, wherein at least one of the drum and the sound radiation panel is selected to have a tunable parameter sufficient to provide the desired sound energy and the desired frequency range; coupling the sound radiation panel to the drum to cover at least a portion of the aperture and form a sound generator; and disposing the drum and sound radiation panel in fluid communication with an air conduit of the vehicle, wherein the sound generator is tuned to the desired sound energy and desired frequency range.

BRIEF DESCRIPTION OF THE DRAWINGS

The above, as well as other objects and advantages of the invention, will become readily apparent to those skilled in the art from a reading the following detailed description of the invention when considered in the light of the accompanying drawings in which.

DETAILED DESCRIPTION OF THE INVENTION

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, are not necessary or critical.

Figure 1:
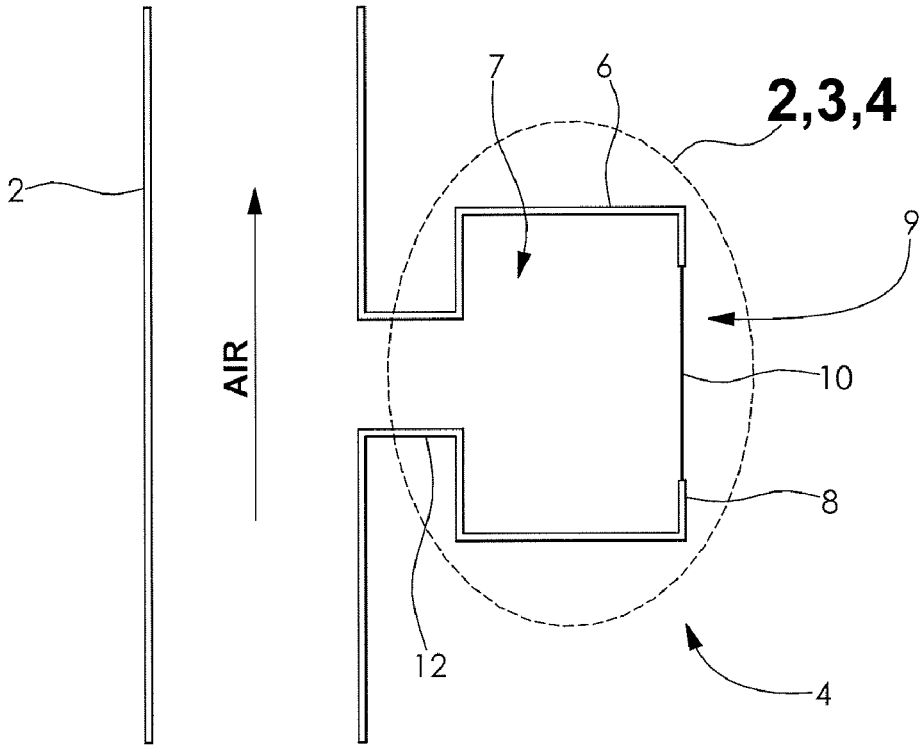
FIG. 1 is a schematic diagram of a sound generator including a drum and a radiation panel in accordance with an embodiment of the disclosure.

FIG. 1 shows an air conduit 2 according to an embodiment of the disclosure. A first end of the air conduit is in fluid communication with an internal combustion engine (not shown) which is adapted to be disposed in an engine compartment of a motor vehicle. The air conduit 2 is in fluid communication with at least one of an air induction system and an air exhaust system. An air stream flows through the air conduit 2 as indicated by the directional arrow of FIG. 1 to the internal combustion engine. As is known in the art, the air induction system is typically adapted to deliver a stream of substantially clean air to the internal combustion engine. The air exhaust system, also as is known in the art, is adapted to direct a stream of exhausted air away from the internal combustion engine and to a vehicle exhaust system.

In particular embodiments, the air conduit 2 is an inlet air duct, such as a cold charge duct for a turbo or supercharged engine, or a clean air duct for a normally-aspirated engine, in fluid communication with the air induction system. As a nonlimiting example, the air conduit 2 may be disposed between an air filter and a throttle body of the air induction system. In other embodiments, the air conduit 2 is an exhaust air duct in fluid communication with the air exhaust system. The air conduit 2 includes at least one high acoustic pressure area zone that may be used for sound generation, for example.

A sound generator 4 is in fluid communication with the air conduit 2. The sound generator 4 includes a drum 6 having a cavity 7 formed therein which is defined, at least in part, by a wall 8 of the drum 6. The cavity 7 is configured to 1) provide amplification of the acoustic pressure waves or "noise" from the air conduit 2, and 2) provide tuning for a coupled or uncoupled acoustic response of the sound generator 4. The drum 6 and cavity 7 may have any suitable shape, as desired. In a particular embodiment, the drum 6 has a circular shape in cross section. In another embodiment, the drum 6 has a rectangular shape in cross section. The drum 6 has an aperture 9 formed therein. The aperture 9 provides communication between the cavity 7 of the drum 6 and the atmosphere.

The sound generator 4 further includes a connector conduit 12. The connector conduit 12 is coupled to the air conduit 2, and provides fluid communication between the air conduit 2 and the sound generator 4. In an illustrative embodiment, the connector conduit 12 provides a lesser volume than a volume represented by the cavity 7 of the sound generator 4. For example, the connector 12 may be adapted to tune the response frequency of cavity 7 to either coupled or uncoupled with the sound radiation panel 10 response frequency. In another embodiment, the connector 12 may be adapted to control the sound energy transmitted from the air conduit 2 to the cavity 7. A suitable connector conduit 12 size may be selected as desired.

A skilled artisan should understand that the drum 6 may be formed from any suitable material as desired. For example, suitable materials may include at least one of a thermoplastic, a thermoset, a metal, and a composite material. In particular embodiments the drum may be formed by one of an injection molding and a blow molding process with a thermoplastic or a thermoset material. One of ordinary skill in the art should also appreciate that suitable dimensions of the cavity 7 may be selected, for example, to generate a desired amount of the acoustic pressure waves to the air conduit 2.

The sound generator 4 of the disclosure also has at least one sound radiation panel 10 which covers the aperture 9. The sound radiation panel 10 is both structurally and acoustically coupled to the drum 6. As used herein, the term "acoustically coupled" means that the sound radiation panel 10 is adapted to convert noise in the cavity 7 of the drum 6 into sound energy in a desired frequency range. For example, the sound radiation panel 10 is adapted to vibrate in response to the acoustic pressure waves routed from the air conduit to the drum cavity 7, and thereby radiate the desired sound energy. It should also be understood that the sound radiation panel 10 may be selected as desired to have multiple modes of vibration in a particular frequency range, thereby providing an optimized sound energy over a broad frequency range, for example.

The sound energy from the sound generator 4 is directed by the sound radiation panel 10 toward at least one of the engine compartment and the vehicle interior. The sound in at least one of the vehicle interior and the vehicle exterior is thereby modulated.

The sound radiation panel 10 is formed from a material suitable for transmitting sound energy. Suitable materials include, for example, at least on of a metal, a polymer, and a composite material. Illustratively, the sound radiation panel 10 may be a plate formed of a metal selected from one of brass and stainless steel. The sound radiation panel 10 may also be a rubber or composite diaphragm, for example. In particular embodiments, the sound radiation panel 10 is a substantially flexible panel having a thickness that may range from a thin membrane to a plate. A skilled artisan should appreciate that suitable materials and plate thicknesses may be selected to produce a desired frequency in response to the sound energy delivered thereto. The suitable materials and plate dimensions may also provide a sound radiation panel 10 that is substantially insensitive to temperature and humidity changes, which typically occur during vehicle operation. Such changes in temperature and humidity can result in an undesirable shift in the desired frequency produced by the sound radiation panel of polymeric springs-mass systems in sound generators of the art.

In one embodiment, the sound radiation panel 10 may be integrally formed with the wall 8 of the drum 6. For example, the sound radiation panel 10 may be a thinned-out portion of the wall 8. Alternatively, the sound radiation panel 10 may be an independent component affixed to the drum 6. For example, the sound radiation panel 10 may be removably coupled to the drum 6, such as by clamping.

It should be understood that the sound radiation panel 10 may be removable. Being removable, different sound radiation panels 10 may be employed as desired to provide selective tuning of the sound generator 4. Alternatively, the sound radiation panel 10 may be permanently coupled to the drum 6, such as by welding of the sound radiation panel 10 to the drum wall 8.

Figure 2:
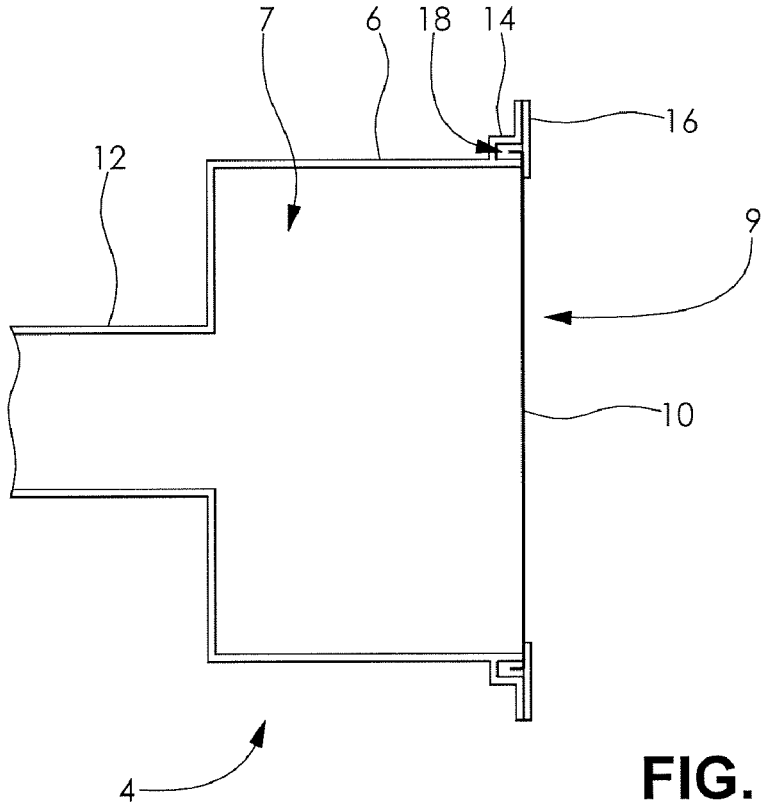
FIG. 2 is a schematic diagram of the sound generator shown in FIG. 1, depicting the drum with outboard features for coupling the radiation panel to the drum.

As shown in FIG. 2, the drum 6 of the sound generator 4 may include a platform 14. The platform 14 is disposed adjacent and substantially surrounds the aperture 9, for example, and may be an independent component coupled to the drum 6. Alternatively, the platform 14 may be formed integrally with the drum 6.

The platform 14 illustrated in FIG. 2 has an outboard configuration. The outboard configuration is particularly suitable for production by injection molding, for example. A cover plate 16 is employed in conjunction with the platform 14 to couple the sound radiation panel 10 to the drum 6. The cover plate 16 may be affixed, for example, by adhesive or welding to the platform 14, with the sound radiation panel 10 disposed therebetween. In a nonlimiting example, the cover plate 16 is a substantially planar ring that circumscribes the aperture 9 of the drum 6.

In a particular embodiment, a sealing channel 18 is disposed between the platform 14 and the aperture 9. The sealing channel 18 receives a peripheral edge of the sound radiation panel 10. A substantially air tight seal may thereby be formed when the cover plate 16 is affixed to the platform 14 of the drum 6.

Figure 3:
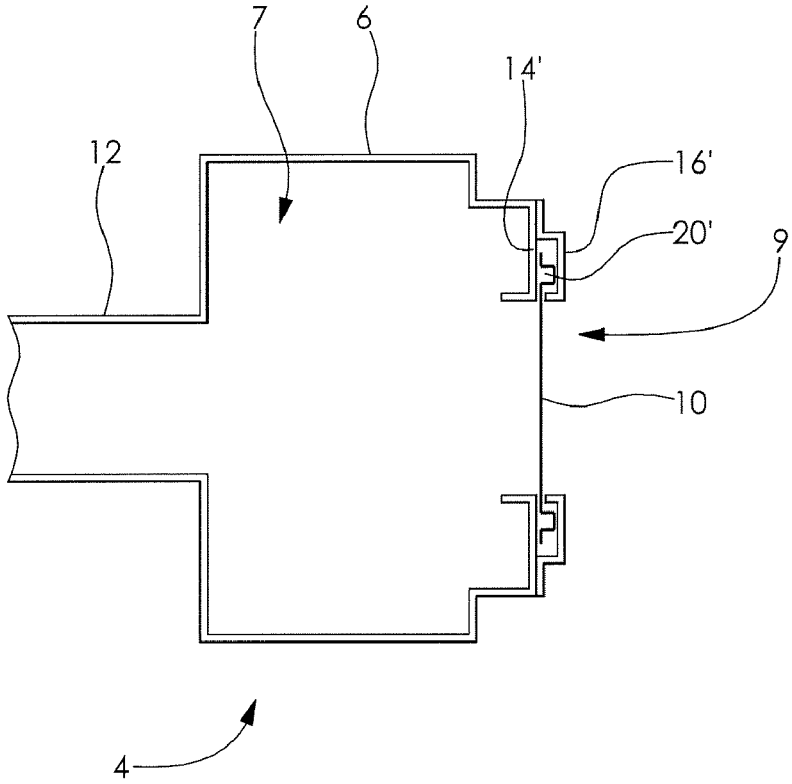
FIG. 3 is a schematic diagram of the sound generator shown in FIG. 1, depicting the drum with inboard features for coupling the radiation panel to the drum.

FIG. 3 shows another embodiment of the disclosure. Like structure from FIGS. 1 and 2 includes the same reference numeral and a prime symbol (') for purpose of clarity. The platform 14' has an inboard configuration. A skilled artisan should understand that the inboard configuration is particularly suitable for production by blow molding, for example. The cover plate 16' has an angled or hook-like configuration. The cover plate 16' is adapted to receive a surface feature 20 of the sound radiation panel 10. The surface feature 20 may be formed in the sound radiation panel 10, for example, by stamping or molding. In the illustrated embodiment, the surface feature is a protuberance, although other surfaces features can be used. A substantially air tight seal may be formed when the cover plate 16' is affixed to the platform 14', with the surface feature 20 of the sound radiation panel 10 disposed therebetween.

Figure 4:
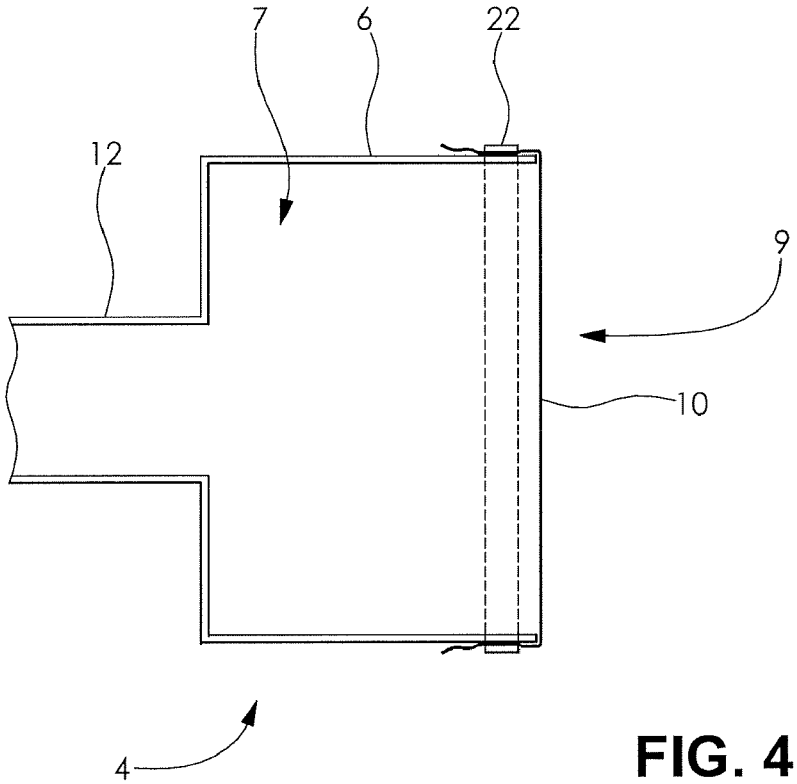
FIG. 4 is a schematic diagram of the sound generator shown in FIG. 1, depicting a clamp for coupling the radiation panel to the drum.

In FIG. 4, a further embodiment of the disclosure is shown. The sound generator 4 includes a clamp 22 configured for coupling the sound radiation panel 10 to the drum 6. In the embodiment shown, the clamp 22 is a band, such as an elastic band or an adjustable metal band clamp, for example, disposed around the drum 6. The clamp 22 snugly fits over the drum 6 to couple the sound radiation panel 10 to the drum 6 and cover the aperture 9. The clamp 22 facilitates the formation of a substantially air tight seal between the sound radiation panel 10 and the drum 6.

Figure 5:
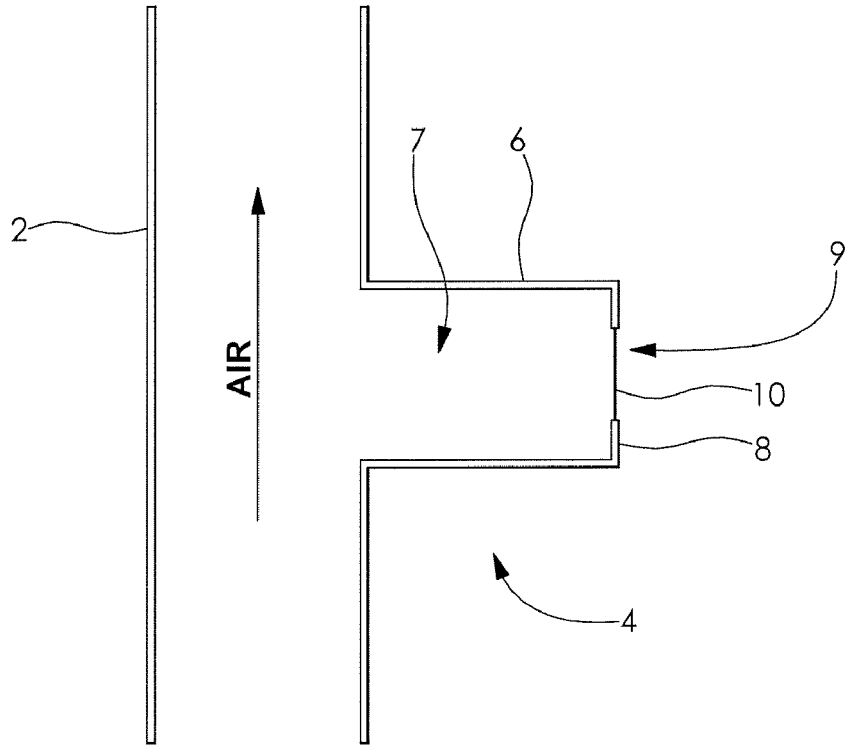
FIG. 5 is a schematic diagram of a sound generator including a port and a radiation panel in accordance with another embodiment of the disclosure.

FIG. 5 shows a further configuration of the sound generator 4 wherein the drum 6 is in direct fluid communication with the air conduit 2. For example, the drum 6 of the sound generator 4 may formed from a T-portion of the air conduit 6. The sound radiation panel 10 is coupled to the drum 6 by any suitable means to provide a substantially air tight seal between the sound radiation panel 10 and the drum 6. The coupling means may include those previously described herein for FIGS. 2, 3, and 4.

Figure 6:
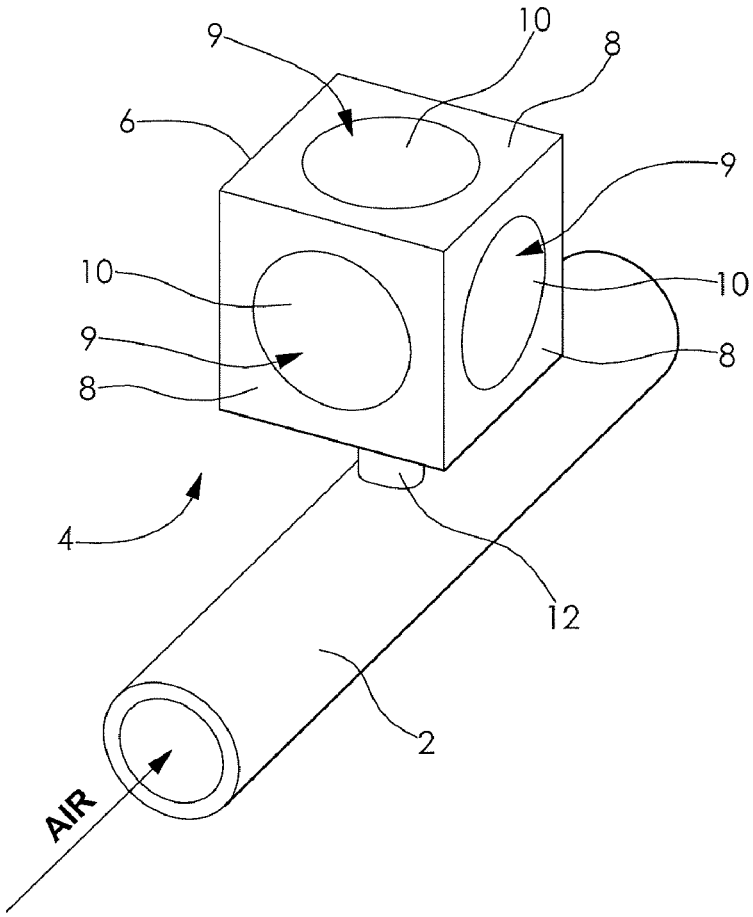
FIG. 6 is a perspective view of a sound generator having a plurality of radiation panels in accordance with a further embodiment of the disclosure.
Figure 7:
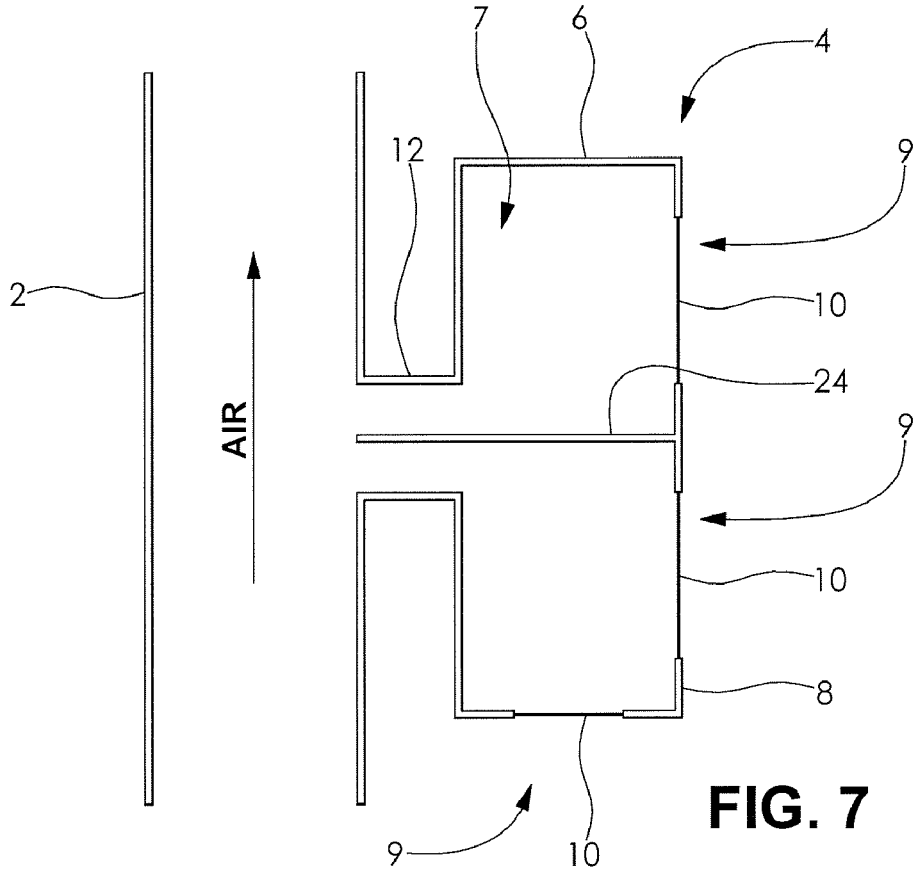
FIG. 7 is a schematic diagram of a sound generator with a plurality of radiation panels, further having an interior wall for directing acoustic pressure waves to the plurality of radiation panels.

As shown in FIGS. 6 and 7, the sound generator 4 of the present disclosure may include a plurality of the apertures 9 and a plurality of the sound radiation panels 10. The sound radiation panels 10 may be disposed at various locations on the sound generator 4. For example, the sound radiation panels 10 may be disposed at the same or different walls 8 of the drum 6. The plurality of sound radiation panels 10 are adapted to selectively modulate sound from different sources and at different frequencies. It should also be understood that each of the plurality of sound radiation panels 10 may have the same frequency, as desired, to generate increased sound energy over the same frequency range.

The sound generator 4 also may have at least one interior wall 24, as illustrated in FIG. 7. The interior wall 24 is configured to selectively direct acoustic pressure waves from the air conduit 2 to the plurality of sound radiation panels 10. The interior wall 24 may be configured to provide substantially the same quantity of acoustic pressure waves to each of the plurality of sound radiation panels 10, for example. As a further nonlimiting example, the interior wall 24 is configured to direct a first quantity of acoustic pressure waves to one of the sound radiation panels 10 that is greater than a second quantity of acoustic pressure waves to an other of the sound radiation panels 10. It is understood that the interior wall 24 can have any shape and size as desired to selectively direct acoustic pressure waves within the sound generator 4. Additionally, apertures and other surface modifications can be formed on the interior wall to selectively direct the acoustic pressure waves.

Figure 8:
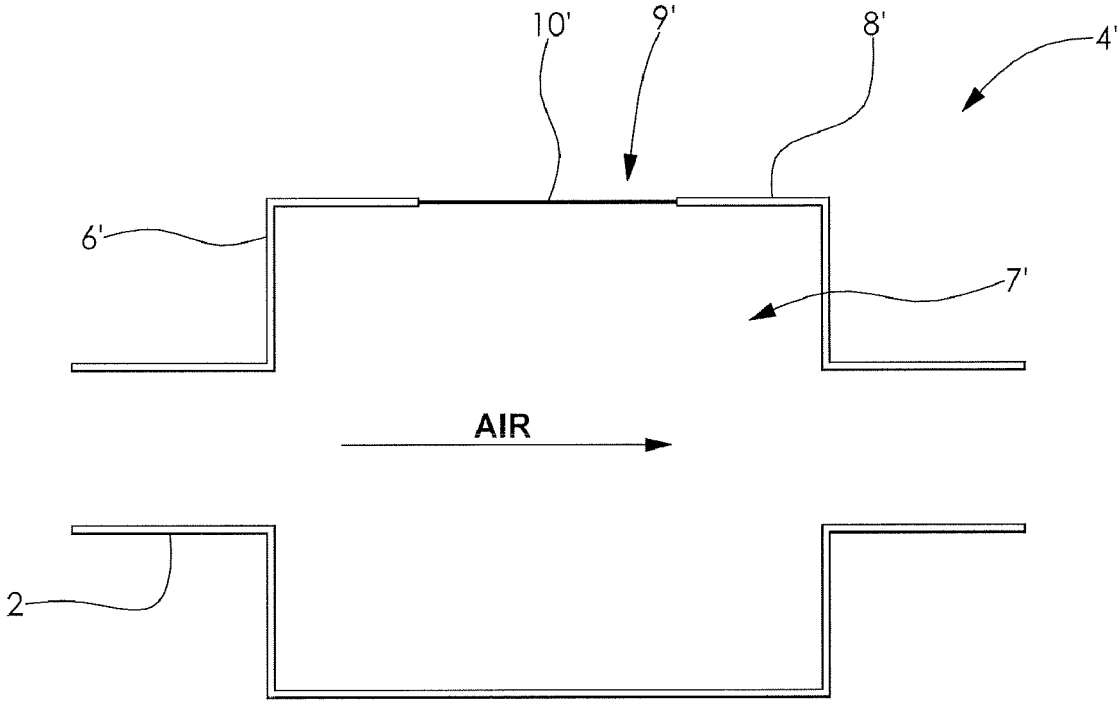
FIG. 8 is a schematic diagram of an in-line sound generator including a drum and a radiation panel in accordance with another embodiment of the disclosure.
Figure 9:
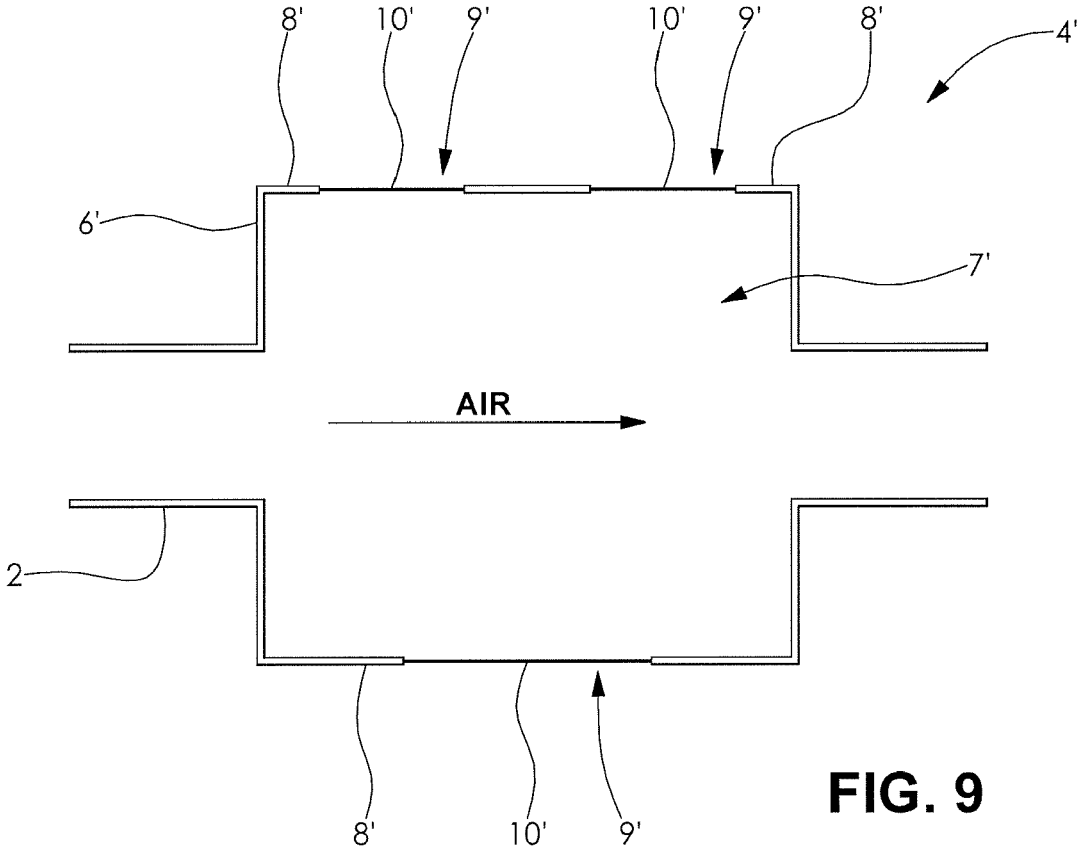
FIG. 9 is a schematic diagram of the in-line sound generator depicted in FIG. 8, further having a plurality of radiator panels.
Figure 10:
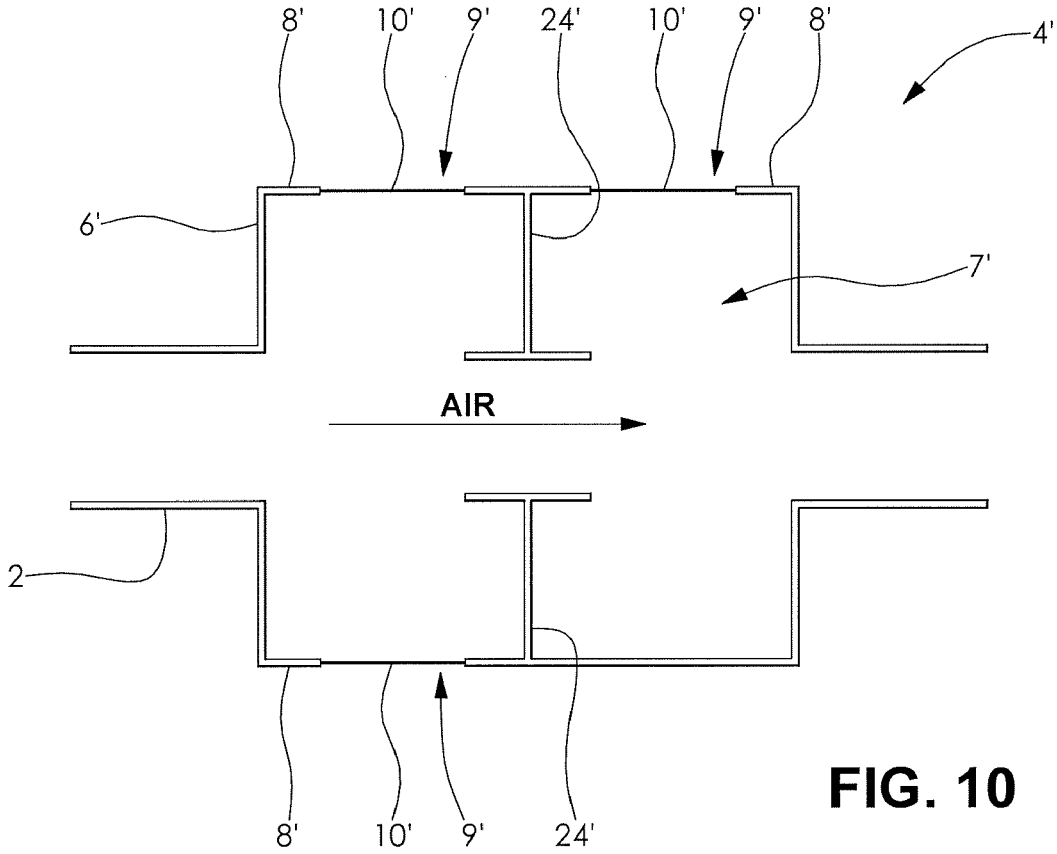
FIG. 10 is a schematic diagram of the in-line sound generator depicted in FIG. 9, further having interior walls for directing acoustic pressure waves to the plurality of radiation panels.

Another embodiment of the disclosure is shown in FIGS. 9 to 11. Like structure from FIGS. 1 to 7 include the same reference numeral and a prime symbol (') for purpose of clarity. As shown in FIG. 8, the sound generator 4' may be configured to be in-line with the air conduit 2. The sound generator 4' includes the drum 6' with the cavity 7' formed therein and defined by the wall 8'. The cavity 7' is configured to allow the air stream of the air conduit 2 to flow therethrough. The drum 6' includes the aperture 9' formed in the wall 8'. The sound radiation panel 10' is coupled to the drum 6' and disposed adjacent the aperture 9'. The sound radiation panel 10' is coupled to the drum 6' by any suitable means for producing a substantially air-tight seal including, for example, the means previously described herein for FIGS. 2, 3, and 4.

With reference to FIGS. 9 and 10, the in-line sound generator 4' may include a plurality of the sound radiation panels 10' and a plurality of interior walls 24' as previously disclosed herein. The interior walls 24' may be configured to provide a continuation of the air conduit 2 within the drum 6', the air conduit 2 being broken intermittently and supported along a length of the conduit 2 to provide fluid communication between the air conduit 2 and the cavity 7' of the drum 6'. Alternatively, the air conduit 2 may extend through the drum 6' and have at least one perforation for fluid communication with the cavity 7' of the drum 6'. A skilled artisan should appreciate that a variety of other configurations of the interior walls 24' may be selected as desired.

The present disclosure also includes a method for manufacturing the sound generator 4, 4' for the vehicle. The method first includes the steps of determining a desired sound energy and a desired frequency range. At least one of the desired sound energy and the desired frequency range are employed to modulate sound quality in at least one of an engine compartment and a vehicle interior. For example, if the desired purpose for the sound generator is to act as a resonator in the vehicle, a sufficient sound energy and frequency that is 180 degrees out of phase with a targeted noise may be determined. Alternatively, a desired sound energy and frequency range for providing an aesthetically pleasing vehicle sound may be determined. Any known means for determining the requisite sound energy and frequency range for at least one of these purposes may be used.

The method includes a step of selecting a drum 6, 6' having a cavity 7, 7' formed therein. An aperture 9, 9' is formed in a wall 8, 8' of the drum 6, 6'. A sound radiation panel 10, 10' is also selected. At least one of the drum 6, 6' and the sound radiation panel 10, 10' are selected to have a tunable parameter sufficient to provide the desired sound energy and frequency ranges determined in the initial steps of the method. The tunable parameter may include at least one of a drum material, a cavity volume, a cavity length, a drum wall thickness, a panel material, a panel surface area, a panel thickness, a connector length, and a connector volume.

The sound radiation panel 10, 10' is then structurally and acoustically coupled to the drum 6, 6' adjacent the aperture 9, 9'. The drum 6, 6' is further disposed in fluid communication with the air conduit 2 of the vehicle. The sound generator 4, 4', tuned to the desired sound energy and frequency ranges, is thereby provided.

As should be appreciated, the sound generator 4, 4' of the present disclosure is particularly suitable for use in a motor vehicle having an internal combustion engine. The sound generator 4, 4' is readily configurable to meet various tuning requirements, for example, by selecting the drum 6, 6' and the panels 10, 10' having the desired tunable parameters, or interchanging the panels 10, 10' in the drum 6, 6' as desired. Thus, the sound generator 4, 4' may be selectively configured to perform as a resonator and suppress sound in at least one of the vehicle interior and exterior, or to provide additional and aesthetically pleasing sound for high performance or sports car applications.

It is also surprisingly found that a single sound radiation panel 10, 10' may have multiple modes of vibration in a desired frequency range. Having the multiple modes of vibration may result in a greater sound energy over a larger frequency range than with single resonant frequency devices known in the art. The sound generator 4, 4' is also less structurally complex, having only a single cavity 7, 7', for example, than known sound generators or resonators. Favorable results have been obtained for the radiation panel 10, 10' having multiple modes of vibration in a desired frequency range using a sound radiation panel 10, 10' produced from a metal material.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A sound generator for a vehicle, comprising:

a hollow drum having an outer wall with an aperture formed therein, the outer wall defining a cavity of the drum, the drum adapted to be coupled to and in fluid communication with an air conduit, an interior wall disposed in the drum configured to selectively direct acoustic pressure waves therein, wherein the interior wall is integrally formed with the outer wall of the drum and extends inwardly from the outer wall of the drum into the cavity of the drum, the interior wall having a free end;

a sound radiation panel disposed in and at least partially covering the aperture and adapted to radiate sound energy to at least one of an engine compartment and an interior of the vehicle; and a connector conduit disposed between the drum and the air conduit to provide fluid communication therebetween.

2. The sound generator of claim 1, wherein the drum includes a platform disposed adjacent and surrounding the aperture of the drum, the platform having an outboard portion projecting radially outward from the outer wall of the drum.

3. The sound generator of claim 2, wherein the platform includes a sealing channel receiving a peripheral edge of the sound radiation panel, the sealing channel formed in the outboard portion and surrounding the aperture formed in the outer wall of the drum.

4. The sound generator of claim 1, wherein the interior wall includes a first portion and a second portion, the first portion extending inwardly from the outer wall of the drum and the second portion disposed at the free end of the interior wall and oriented substantially orthogonal to the first portion of the interior wall, wherein the interior wall is substantially T-shaped in cross-section.

5. The sound generator of claim 1, wherein the radiation panel is adapted to vibrate in response to acoustic pressure waves in the air conduit to radiate sound energy.

6. The sound generator of claim 1, wherein the sound radiation panel is removable.

7. The sound generator of claim 1, wherein the sound radiation panel is integral with the drum.

8. The sound generator of claim 1, wherein the sound radiation panel is formed from at least one of a metal, a polymer, and a composite material.

9. The sound generator of claim 3, further comprising a cover plate coupled to the platform of the drum, the sound radiation panel disposed between the cover plate and the drum, wherein a substantially air tight seal is formed between the platform, the sound radiation panel, and the cover plate when the cover plate is coupled to the platform.

10. The sound generator of claim 9, wherein the cover plate is a substantially planar ring.

11. The sound generator of claim 1, further including a clamp disposed around the drum for coupling the sound radiation panel to the drum.

12. A vehicle system for modulating sound in at least one of an engine compartment and a vehicle interior, the vehicle system comprising:

an internal combustion engine disposed in the engine compartment;

an air conduit in fluid communication with the internal combustion engine; and a sound generator comprising:

a hollow drum in fluid communication with the air conduit, the drum having an outer wall with an aperture formed therein, the outer wall defining a cavity of the drum;

a sound radiation panel disposed in and at least partially covering the aperture adapted to radiate sound energy to at least one of the engine compartment and the vehicle interior;

an interior wall disposed in the drum configured to selectively direct acoustic pressure waves therein, wherein the interior wall is integrally formed with the outer wall of the drum and extends inwardly from the outer wall of the drum into the cavity of the drum, the interior wall having a free end; and a connector conduit disposed between the drum and the air conduit to provide fluid communication therebetween.

13. The vehicle system of claim 12, wherein the air conduit is an inlet air duct adapted to be in fluid communication with an air induction system.

14. The sound generator of claim 12, wherein the sound radiation panel is formed from at least one of a metal, a polymer, and a composite material.

15. The vehicle system of claim 12, wherein the air conduit is an exhaust air duct adapted to be in fluid communication with the air exhaust system.

16. A method for manufacturing a sound generator for a vehicle, the method comprising the steps of:

determining a desired sound energy;

determining a desired frequency range;

selecting a hollow drum with an outer wall having an aperture formed therein, the outer wall defining a cavity of the drum, an interior wall disposed in the drum configured to selectively direct acoustic pressure waves therein, wherein the interior wall is integrally formed with the outer wall of the drum and extends inwardly from the outer wall of the drum into the cavity of the drum, the interior wall having a free end;

selecting a sound radiation panel;

selecting a connector conduit, wherein at least one of the drum, the sound radiation panel, and the connector conduit is selected to have a tunable parameter sufficient to provide the desired sound energy and the desired frequency range;

coupling the sound radiation panel to the drum in the aperture to cover at least a portion of the aperture and form a sound generator; and disposing the connector conduit between the drum and an air conduit to provide fluid communication therebetween, wherein the sound generator is tuned to the desired sound energy and desired frequency range.

17. The method of claim 16, wherein at least one of the desired sound energy and the desired frequency range is employed to modulate a sound quality in at least one of an engine compartment and a vehicle interior.

18. The method of claim 16, wherein the tunable parameter includes at least one of a drum material, a cavity volume, a cavity length, a drum wall thickness, a panel material, a panel surface area, a panel thickness, a connector length, and a connector volume.

19. The method of claim 16, wherein the drum is provided with a platform formed adjacent the aperture and surrounding the aperture of the drum, the platform having an outboard portion projecting radially outward from the outer wall of the drum.

20. The method of claim 19, wherein the platform is provided with a sealing channel adapted to receive a peripheral edge of the sound radiation panel, the sealing channel formed in the outboard portion and surrounding the aperture formed in the outer wall of the drum.

* * * * *